US010765183B2

(12) United States Patent
Wilser

(10) Patent No.: US 10,765,183 B2
(45) Date of Patent: Sep. 8, 2020

(54) JEWELRY ELEMENT AND PRODUCTION METHOD

(71) Applicant: ALEXANDER WILSER GMBH, Remchingen (DE)

(72) Inventor: Alexander Wilser, Bruchsal (DE)

(73) Assignee: Alexander Wilser GmbH, Remchingen (DE)

( * ) Notice: Subject to any disclaimer, the term of this patent is extended or adjusted under 35 U.S.C. 154(b) by 327 days.

(21) Appl. No.: 15/526,168

(22) PCT Filed: Apr. 16, 2015

(86) PCT No.: PCT/EP2015/000795
§ 371 (c)(1),
(2) Date: May 11, 2017

(87) PCT Pub. No.: WO2016/074751
PCT Pub. Date: May 19, 2016

(65) Prior Publication Data

US 2018/0242699 A1 Aug. 30, 2018

(30) Foreign Application Priority Data

Nov. 12, 2014 (DE) ..... 10 2014 016 677

(51) Int. Cl.
*A44C 17/00* (2006.01)
*A44B 11/02* (2006.01)
(Continued)

(52) U.S. Cl.
CPC ..... *A44C 17/02* (2013.01); *A44B 11/001* (2013.01); *A44C 17/04* (2013.01); *A44C 17/046* (2013.01); *A41F 9/002* (2013.01); *A44B 11/22* (2013.01)

(58) Field of Classification Search
CPC . A44C 17/02; A44C 17/0208; A44C 17/0233; A44C 17/04; A44C 17/046; A44B 11/001; A44B 11/22; A41F 9/002
(Continued)

(56) References Cited

U.S. PATENT DOCUMENTS 242,422 A * 6/1881 Ballou ..... A44C 17/0208 63/29.1
795,109 A * 7/1905 Dover ..... A44C 17/02 29/10
(Continued)

FOREIGN PATENT DOCUMENTS

CN 201640730 U 11/2010
CN 201675167 U 12/2010
(Continued)

OTHER PUBLICATIONS

International Search Report (in English and German) and Written Opinion of the International Searching Authority (in German) issued in PCT/EP2015/000795, dated Sep. 8, 2015; ISA/EPO.
(Continued)

*Primary Examiner* — Jack W Lavinder
(74) *Attorney, Agent, or Firm* — Slater Matsil, LLP

(57) ABSTRACT

The present invention discloses an adorning element which comprises a base body having a front side and a rear side. At least one gem (4) is disposed in the base plate (1). In addition, a through hole (2) which receives the gem (4) is disposed in the base body for each gem (4). At least one retaining element (21) which projects into the through opening or through hole (2) and which supports the gem (4) is disposed at an end of the through hole (2) facing the front side of the base body. A holding device which holds the gem (4) in a defined position in the through hole (2) is arranged at the through opening or through hole (2) on the rear side.
(Continued)

In addition, a method for manufacturing the adorning element according to the invention is disclosed.

22 Claims, 6 Drawing Sheets

(51) Int. Cl.

| | |
|---|---|
| ***A44C 17/02*** | (2006.01) |
| ***A44B 11/00*** | (2006.01) |
| ***A44C 17/04*** | (2006.01) |
| *A41F 9/00* | (2006.01) |
| *A44B 11/22* | (2006.01) |

(58) Field of Classification Search
USPC ..... 63/28, 29.1
See application file for complete search history.

(56) References Cited

U.S. PATENT DOCUMENTS

| | | | | |
|---|---|---|---|---|
| 1,442,815 | A * | 1/1923 | Maker | A44C 17/02 29/10 |
| 3,931,719 | A | 1/1976 | Schwab | |
| 6,116,054 | A * | 9/2000 | Czupor | A44C 17/0233 63/26 |
| 2003/0014996 | A1 | 1/2003 | Feuer | |
| 2007/0204463 | A1 | 9/2007 | Apprederisse et al. | |

FOREIGN PATENT DOCUMENTS

| | | | | |
|---|---|---|---|---|
| CN | 202425733 | U | 9/2012 | |
| CN | 103720144 | A | 4/2014 | |
| DE | 2321157 | A1 | 11/1973 | |
| DE | 19606587 | A1 * | 8/1997 | A44C 17/0233 |
| DE | 20204692 | U1 | 7/2002 | |
| DE | 20304692 | U1 | 8/2003 | |
| DE | 202013101780 | U1 | 5/2013 | |
| EP | 1825773 | A1 | 8/2007 | |
| FR | 2421577 | A1 | 11/1979 | |
| FR | 2524779 | A1 | 10/1983 | |
| GB | 2042869 | A | 10/1980 | |
| JP | H0222106 | U | 2/1990 | |
| JP | H05228009 | A | 9/1993 | |
| JP | H09136247 | A | 5/1997 | |
| JP | H11350224 | A | 12/1999 | |
| KR | 20110003946 | A | 1/2011 | |

OTHER PUBLICATIONS

International Preliminary Report on Patentability (in German) for PCT/EP2015/000795, IPEA/EPO, Rijswijk, dated Feb. 28, 2017.

* cited by examiner

JEWELRY ELEMENT AND PRODUCTION METHOD

CROSS-REFERENCE TO RELATED APPLICATIONS

This application is a 371 U.S. National Stage of International Application No. PCT/EP2015/000795, filed Apr. 16, 2015, which claims the benefit of and priority to German Patent Application No. 10-2014-016677.5, filed on Nov. 12, 2014, The disclosures of the above applications are incorporated herein by reference.

The invention following below refers to an adorning element and a method for manufacturing the same.

There are known adorning elements that are decorated with gems, for example in the form of belt buckles, which include, for example, true gemstones or diamond imitations. Often, diamond imitations are simply glued to the visible front side of the belt buckle clasp, while diamonds are also mounted in settings such as they are known from jewelry making.

However, glued gems may come off because the glue ages, and the making of settings is a precision mechanical practice that is complex in terms of time and cost.

This results in the object of creating an adorning element decorated with gems, in which the gems are held in a safe and undetachable manner.

In addition, this results in the object of creating a method for the manufacture of the adorning element, which allows a safe attachment of gems, said attachment being designed such that the gems are received in the adorning element in an undetachable manner.

In a first embodiment, the adorning element according to the invention includes a base body that is made out of metal, having a front side and a rear side in each of which a through opening is provided for each gem. Depending on the method for manufacturing the base body, this opening may be drilled, i.e., be a through hole. If a casting method is used, there is no need for drilling; instead, the opening can already be made in the casting process. The gem is received in the through opening or through hole without setting. The diameter or the cross-sectional shape of the through opening or through hole and the diameter of the gem therefore correspond to each other such that the gem can just be inserted. A circumferential collar as retaining element is provided at an end of the through hole facing the front side of the base body, and projects radially into the through opening or hole and supports the gem. Finally, a holding device which holds the gem in a defined position in the through hole is arranged at the through hole on the rear side. In relation to the base body, "front side" refers, herein, to the decorated side which shows the gem or gems; "rear side" accordingly refers to the side facing away therefrom. The holding device comprises a cover plate which covers the base body in the vicinity of the through opening(s) or through hole(s) such that each gem is held in its defined position in its through opening or through hole.

The invention is to advantage in that the gem, by cooperation of the projecting retaining element with the diameter or cross-section of the gem itself, is protected against falling out in the direction of the decorated side in a form-locking manner; the corresponding mating form closure in the direction of the rear side is formed by the holding device. The fact that force-locking attachments and glued connections are done without results in a safe attachment of the gems and in the gems being fully shown to advantage in terms of light refraction. The gem cannot fall out, not even in case of heavy impact loads or the like. This allows using high-priced true jewels in the clasp because any detachment is impossible due to the design principle.

In addition to the cover plate, the holding device can include a fixing element for each through opening or through hole, said fixing element closing the through opening or through hole on the rear side and being arranged in the through opening or through hole. The cover plate covers all of the fixing elements.

The retaining element is a collar that is circumferential. Advantageously, a complete collar is provided because said collar can be produced more easily and in an automated manner and, therefore, more cost-effectively. Advantageously, the circumferential collar is formed by a blind hole being produced coaxially with the through hole from the rear side of the base body, said blind hole having a diameter that is in excess of the diameter of the through hole.

It should be noted that, in the following, through opening or through hole may, alternatively, refer to the recess that receives the gem. On the one hand, the term "hole" refers to the type of manufacture, i.e., drilling, and to the cylindrical recess produced therewith. In general, however, the recess does not have to be cylindrical if the gem does not have any circular base. The person skilled in the art knows how to adjust the shape of the recess or opening to the cross-sectional base of the gem.

The base body can include one or a plurality of closing devices which, however, can be corresponding to each other in pairs, depending on the adorning element. If the adorning element is an earring, the closing device may be understood to mean a pin and an associated receiving hole. A closing device can be selected from the group consisting of a bracket, a knob, a ball head or a spike, wherein the bracket, knob, ball head or spike is, most preferably, received in the base body by means of a receiving hole or is forged or cast or screwed to the base body. The closing device can also be selected from the group consisting of an eye, a groove, or a recess. Two closing devices which are both provided on the base body can be brought into engagement with each other to achieve a closure in itself wherein, by the way, the base body can consist of multiple parts (as is the case with an earring) which can be connected to each other, for example, by means of a hinge. In other cases, for example, in the case of a belt buckle clasp, a closing element—for example, a ball head—can be brought into engagement with another element—a hole in the belt.

The base body and the closing device may be made of metal. Herein, the metal is, in particular, platinum, gold, silver, noble metal in general, or a metal alloy, more particularly stainless steel, or a combination of the aforementioned metals. Combinations comprise alloys, including cast alloys, and also coatings.

Therein, the base body and the closing device can consist of identical or different metals—for example, different metals can be selected if one part of the adorning element, for example, a ball head in the case of a belt buckle clasp, is subject to wear to a higher extent and should, therefore, be made more robust.

Furthermore, the through opening or through hole can include a depression, preferably a cylindrical depression, at its end facing the rear side of the base plate.

The fixing element can be a plug which closes the through hole on the rear side and can terminate flush with a rear-sided end of the through hole. Alternatively, a clamping ring is suggested, which abuts against a lateral surface of the through hole. The clamping ring can, for example, be a metallic slotted clamping ring or an O-ring having the appropriate dimensions. Alternatively, the fixing element can be a threaded pin or a screw, which is screwed into a threaded section on the rearward end of the through hole.

The plug can be glued into the through hole. However, it can also be provided that the plug is screwed in by means of a thread the plug is provided with—in this case, the through hole includes a mating thread. Unless the through hole is cylindrical, the plug can also be inserted, for example, by grouting.

As an alternative or in addition, the plug can map a negative shape of the through hole along its lateral surface and, preferably, have a front-sided recess which maps the negative shape of a rear side of the gem. If the plug has a negative shape of the through hole, then this means that its shape and its outside diameter correspond to the shape and the inside diameters of the through hole. This also includes that the plug has a collar on its rearward end, the dimensions and shape of which correspond to those of the cylindrical depression. This seals the through hole on the rear side; in order to increase the seal effect, the "collar" of the plug can, for example, be designed a little bit higher than the depth of the cylindrical depression, this resulting in a deformation and pressing of the collar when the cover plate is pressed on.

Advantageously, the plug can consist of the same noble metal as the base body. This is to advantage in that noble metals—if they consistently have the same content for all parts of a multi-part element or gem—can be punched in order to specify the metal standard.

Alternatively, it can also consist of a plastic material, for example, an elastomer and be held through press fit.

According to a further embodiment, it can be provided that a plurality of gems is carried by the base body, said plurality of gems also being arranged in a defined pattern, for example, in the form of letters, numerals or symbols.

Herein, it is also possible to use groups consisting of numerals and letters. Alternatively, the gems may be arranged across the whole or partial surface of the base body. When the surface of the base body is occupied only in part, a form which corresponds to the defined pattern can be left unoccupied. The latter alternative, therefore, virtually represents an inverted variant by generally inserting gems on the whole surface except where letters or other symbols are provided, with the result that an appearance of an even higher quality is achieved. In this manner, the adorning element can, advantageously, be individualised, for example, by the bearer's initials being shown by gems in the clasp. As an alternative or in addition, it can be provided that either the area that is not occupied by gems or the area that is occupied by gems is raised in a relief-like manner.

As a matter of course, the inserted gems can also have different sizes/diameters.

Therein, the cover plate of the holding device can be embedded in a corresponding rear-sided recess of the base body in a detachable or undetachable manner.

An engagement element, preferably a lug, can be provided on the narrow side of the cover plate. It can be brought into engagement with a mating engagement element, preferably with a corresponding slot, that is provided in the recess of the base body, and can close the base body from behind. If the engagement element is intended to close in a detachable manner, it can also be articulated to the base body via one or a plurality of hinges in a pivoting manner. As a matter of course, it is also possible to provide a plurality of engagement elements which can also be designed as spring elements, for example, as flexible tongues. Coloured gems may, therefore, be replaced, for example by the user or a jeweler.

When fixing elements separately provided for each hole are not inserted for holding the gems, the cover plate can also serve as a common holding element for the whole of the gems.

Advantageously, the depth of the recess and the thickness of the cover plate are aligned with each other, with the result that the cover plate does not project beyond the rear side of the base body but terminates flush therewith. Therein, the outside dimensions and the shape of the cover plate correspond to the shape and the dimensions of the cavity, minus a defined play, for example, a few tenths of a millimetre. The cavity and the corresponding recess of the base body can, for example, have a rectangular shape wherein, preferably, the corners are rounded.

The gem may be a diamond and have a circular basic cross-section and, for example, include a brilliant cut. As a matter of course, use can also be made of other non-diamond gems, for example, rubies, sapphires, emeralds, topazes, or other minerals, such as malachite, turquoise, obsidian, and many more, which can be inserted cut or rough. It is also possible to select gems having an oval or polygonal basic cross-section, in crystal form or in cut form. In general, the "gemstone" can also be a crystal. Use can also be made of gems not occurring naturally, for example, diamond imitations or other synthetic gems in cut form.

The "basic cross-section" of the gem is understood to mean the cross-section which is designed to abut against the retaining element (collar) on the front side of the through hole, i.e., the larger cross-section of the essentially cone-shaped gem in case of a brilliant cut.

In one variant, the adorning element can be a clasp wherein, in this case, the base body is a base plate with at least one gem being provided therein. In this case, the adorning element or clasp includes a closing element which is arranged on the rear side of the base plate.

The clasp according to the invention can, in particular, be a belt buckle, a strap buckle (for example for a bag), a book clasp, a purse clasp, a jacket clasp, a shoe clasp, a bag clasp, a suitcase clasp, a clasp for a case of a mobile electronic terminal device, a clock clasp, a clasp for a pair of trousers, a clasp for a cosmetic bag, a clasp for a suit bag, a clasp of a knapsack, or a clasp for braces. Bags can be understood to mean any bags desired, for example, handbags, travelling bags, briefcases, attaché cases, for example made of leather, textile and/or "mixed forms". A case of a mobile electronic terminal device may be a smartphone case, a tablet case or laptop case. Cosmetic bags can be understood to mean all "derivatives", such as sponge bags or vanity cases, etc. However, the invention is not limited to the aforementioned clasp types but also explicitly includes other types.

As has been explained above for the base body, the base plate preferably consists of metal, for example, of noble metals such as platinum, gold, silver or steel, more particularly stainless steel, or of brass, or of combinations of the aforementioned metals. Combinations also comprise metal base plates which are gold-plated or platinised; in general, use can be made of coated, more particularly galvanically coated or PVD-coated metal base plates.

However, the materials mentioned do not limit the invention; in fact, base bodies or base plates that are made of any material that seems suitable are conceivable. And the person skilled in the art also knows the basic shapes of, for example, a ring or an earring, etc.

In a further embodiment, the base plate can be curved, with one axis or multiple axes. If the clasp is a belt buckle, it is advantageously curved such that it harmoniously rests against the bearers body contour, i.e., the curvature has a comparably large radius. In addition to the examples mentioned herein, the clasp according to the invention can also be used for other purposes. As a matter of principle, a clasp is understood to mean a mechanical closing element made of a mostly metallic material which serves to secure small moving parts; this opens up a broad range of applications.

The closing element can be a bracket, a knob, a ball head and/or a spike. Therein, the knob, ball head or spike can be received in a hole of the base plate. A bracket is often used as a fixing element for a belt, with the belt being looped through said bracket. The spike, knob or ball head are, for example, provided to be inserted into a hole of a belt or a strap. Usually, however, a clasp, such as a belt buckle, can comprise not only one fixing element but two fixing elements; for that reason, any combinations of the aforementioned fixing elements can be provided, for example, a bracket or a ball head. The fixing elements mentioned herein are only examples; the clasp according to the invention can, therefore, also comprise other fixing elements while the idea that is essential for the invention is preserved; in this context, a force-locking attachment using a clamping bracket can, for example, be conceivable.

In further embodiments of the invention, the adorning element may be a key chain, a wristband, a bracelet, a case of an electronic terminal device, a ring, a necklace, a cuff button, a money clip, a hairslide, a button, an ear adorning element such as an ear stud or an earring, a part of a necklace, a pendant, a decorating part for hats and/or gloves, a collar (particularly for pets), a decorating part for sports accessories in equestrian sports, golf, tennis or other sports accessories, for example a saddle (e.g., a horse's saddle), but also a temple stem or a tie pin, to which a decorating function is attributed in addition to the technical function.

The list should not be understood to be complete; in fact, a decorating element according to the invention can also be understood to mean other objects or decorating parts that are not mentioned herein and implement the principle of a gem holder according to the invention. Basically, the principle of a gem holder according to the invention is suitable for all decorating parts from the luxury segment.

The method according to the invention for manufacturing a decorating element comprises the following steps:

a) providing a base body blank, b) producing the through opening or through hole in the base body blank, c) arranging or producing the retaining element at the end of the through opening or through hole facing the front side of the base plate, d) inserting the gem into the through opening or through hole from the rear side of the base body and making the gem abutting against the retaining element, e) attaching the holding device to the through opening or through hole on the rear side, and holding the gem by means of the holding device. Therefore, the base body in the vicinity of the through opening(s) or through hole(s) is covered by said cover plate at the rear side of the base body in a manner as such that each gem is held in its defined position in its through opening or through hole.

If necessary, attaching the holding device in step e) may comprise closing the through opening or through hole by means of a fixing element such that the cover plate covers all of the fixing elements, before positioning the cover plate.

When a casting method is used, steps a) and b) are done simultaneously; this also applies to a step b') which provides that a blind hole be produced with a cross-section that is in excess of the diameter of the through opening. In this manner, the collar at the end of the through opening that faces the front side of the base body is achieved.

When the casting method is used, steps a), b) and b'), and also the providing of closing devices, can be made simultaneously if the tool is designed accordingly. However, it can also be provided that only the base body is created and then machined, and that the holes are made consecutively, etc. As a result, the gem will then be made to abut against the collar in step d).

The base body blank can hence be rough-machined in any manner desired; for example, it can be cast and/or rough-machined, with the result that the through openings and gems only need to be inserted for completion. The alternative steps of "arranging" and "producing" the retaining element refer to the potential variants that the retaining element is either a circumferential collar or a radially projecting pin or the like; for example, a pin cannot be produced in the hole but is arranged therein.

Herein, the elements mentioned can be inserted as holding elements, for example, the fixing element among others, which closes the through hole on the rear side and can be inserted into the through hole.

If the retaining element is a circumferential collar, step b') is made after step b): producing a blind hole coaxially with the through hole from the rear side of the base body, said blind hole having a diameter that is in excess of the diameter of the through hole, with the result that the collar is achieved at the end of the through hole facing the front side of the base body.

Contrary to the types of setting for a gem, for example, a cut diamond, that have been known so far, the method according to the invention is suitable for automation; for example, the drill pattern including collar and depression can be made by a CNC-controlled metal-cutting machine. Manual steps are only needed when the gems are inserted. As compared with conventional manufacturing methods, this means a reduction in the amount of work.

According to a further embodiment, in step e) inserting the cover plate into the rear-sided recess of the base body can be carried out, and, thereby, closing the through hole. Additionally in step e) before inserting the cover plate, the plug can be inserted as fixing element into the through hole from the rear side of the base body.

If the adorning element is a clasp, a base plate blank which will subsequently be machined to obtain the base plate is used as base body blank in one embodiment of the method.

Finally, step g) can be made after at least one of steps a), b) and/or c), said step g) comprising coating the base body blank, for example, galvanising, e.g., silver-plating, gold-plating, platinising. However, use can also be made of other (noble) metals which appear to be suitable for being galvanically deposited on the base body blank or the finished base body.

Furthermore, a machine finishing step g') can be considered after one of steps a), b), c) and/or step g), for example, polishing, lapping, brushing or surface refining in any other manner, in order to give the surface of the base body the desired appearance at least on the visible side.

These and other advantages will be illustrated in the following description, with reference being made to the accompanying figures. In the description, the reference to the figures serves to support the description and to facilitate understanding the item. Items or parts of items which essentially are identical or similar can have the same reference numbers. The figures are only schematic representations of exemplary embodiments of the invention.

In the figures.

Figure 6A:
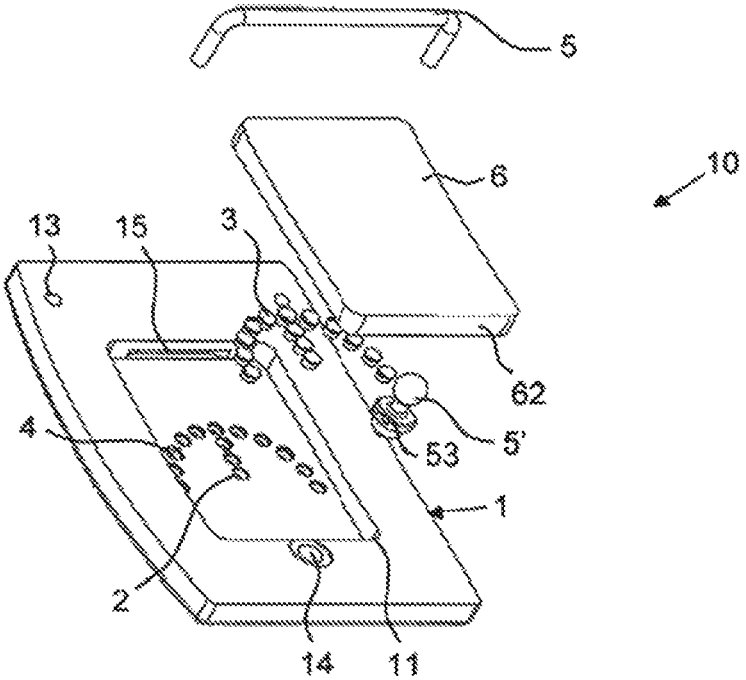
FIG. 6 is a rear view of the belt buckle in perspective.
Figure 7A:
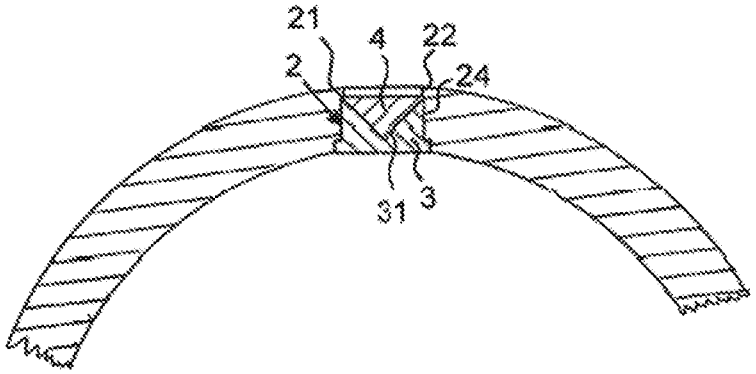
Figure 7B:
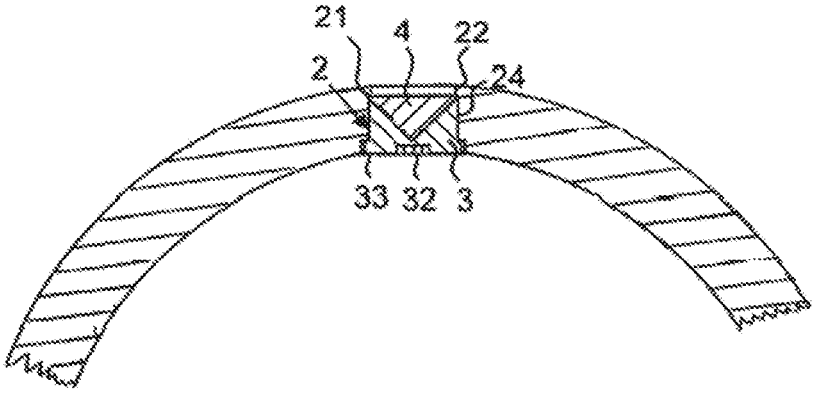
Figure 7C:
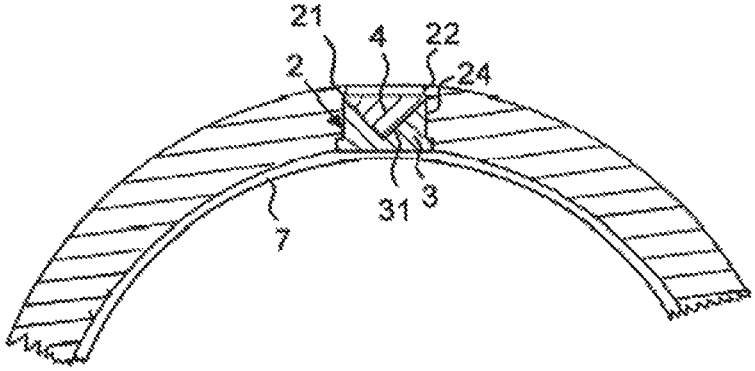
Figure 8:
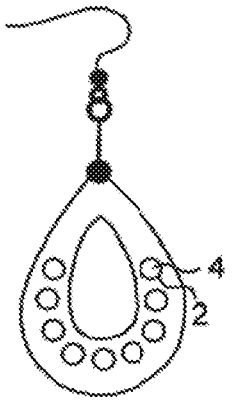

FIG. 6*a,b* are two exploded views of the belt buckle;

FIG. 7*a-c* are sectional views of various embodiments of a ring;

FIG. 8 is a top view of an earring.

The adorning element shown in FIG. 1 to FIG. 6*b* is a belt buckle 10.

The explanations of the principle of manufacturing the belt buckle and its structure essentially apply for all adorning elements which are to be fitted with gems designed according to the invention.

The advantages mentioned therefore refer to a whole entirety of adorning elements.

Figure 1:
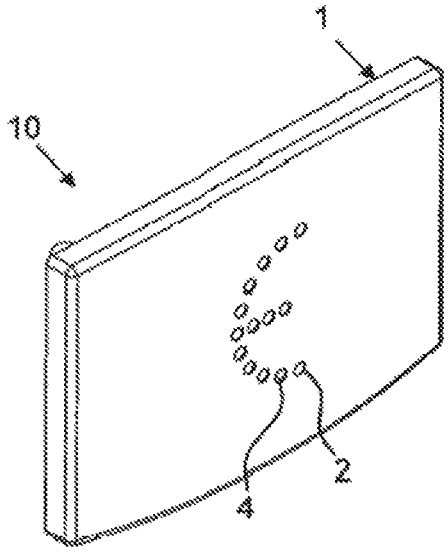
FIG. 1 is a front view of an adorning element in the form of a belt buckle in perspective.

The belt buckle 10 according to the invention, such as it is shown in perspective in FIG. 1, essentially consists of a base plate 1 with gems 4 being inserted therein. In the embodiment shown, the gems 4 are arranged in the pattern of an "E"; in other embodiments, however, the gems 4 can generally be arranged in any pattern desired, in particular in the form of any numerals, numbers, other symbols and combinations thereof; according to a preferred embodiment, it can also be provided that the bearer's initials are mapped by the gems, thus individualising the belt buckle 10.

The base plate 1 of the belt buckle 10 is slightly curved about its transverse axis, with the result that the belt buckle 10 can be comfortably worn on one's body and does not "stick out" from under a piece of outerwear in a disturbing manner.

Figure 2:
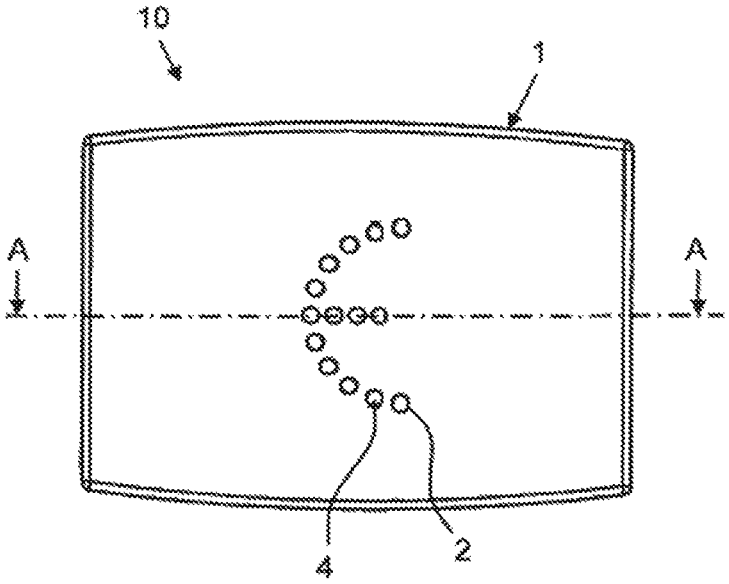
FIG. 2 is a top view of the belt buckle.
Figure 3:
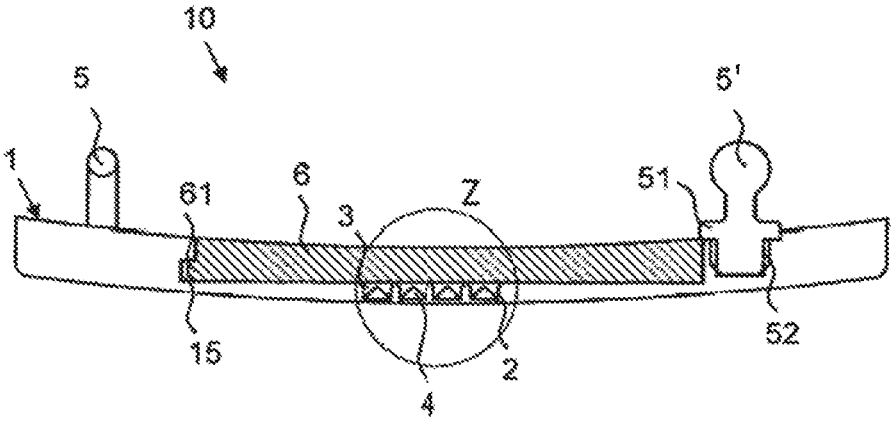
FIG. 3 is a longitudinal sectional view of the belt buckle.

FIG. 3 shows the sectional view taken from line A-A plotted in FIG. 2 from a top view. On its rear side, the belt buckle 10 is provided with fixing means 5, 5' which serve to tie it to a belt; one of the fixing elements 5, 5' is a pin with a ball head 5' which is fitted through a hole in the belt, while the other one is a bracket 5 through which the belt is looped; the function of the fixing elements 5, 5' in this and other embodiments are known to the person skilled in the art.

Figure 4:
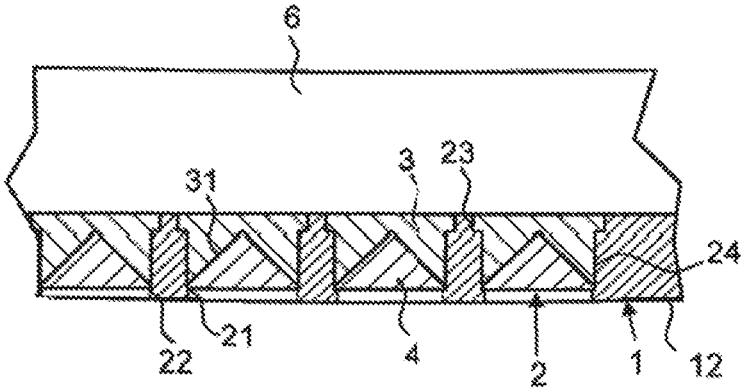
FIG. 4 is a detail of the longitudinal sectional view of the belt buckle.

A plurality of through holes 2 which are arranged in an "E" pattern are provided in the base plate 1. The gems 4 are inserted into the through holes 2 from the rear side. The attachment of the gems 4 in the through hole 2 is shown in FIG. 4 which shows the detail Z from FIG. 3. At their end facing the decorated side, the through holes 2 have a collar 21 which projects radially into the hole 2 in part. During manufacture, a through hole 22 having a small diameter is therefore produced at first, and then a blind hole 24 having a somewhat larger diameter is produced; this results in a collar 21 and, finally, in the actual through hole 2. The collar 21 is provided to ensure that the gems 4 are each supported thereon. Therein, the diameter of the gems 4 is only somewhat smaller than the large diameter of the through hole 2; thereby, the gems 4 are retained to the collar 21 in a form-locking manner, for that reason, they cannot fall out in a forward direction, not even in case of impact, vibration, etc. In the belt buckle 10 according to the invention, the gems 4 can be easily recognized as a decorating element from the front, are fully shown to advantage and are inserted from the rear side of the base plate 1.

Since a setting in the conventional sense is done without and the collar 21 is inconspicuously narrow in relation to its diameter, the attachment does not affect the overall impression; this is contrary to gems with a conventional setting and, above all, also contrary to glued gems which always "stick out" a little bit. On the left side in FIG. 4, the cover plate is held by the cooperation of the slot 15 of the base plate 1 with the lug 61 inserted therein on the narrow side of the cover plate 6. On the right side in FIG. 4, the cover plate 6 is retained by the fixing element, i.e., the ball head 5', having a collar region 51 which projects a little beyond the cover plate 6 on the short side of the cover plate 6. The collar 51 can be firmly pressed to the cover plate 6 via a thread 52. The key attachment 53 which can, for example, be operated with a normal open-ended spanner is provided in order to be able to tighten the knob or ball head 5' such that it is protected against being unscrewed unintentionally.

The gems 4 are inserted into the through hole 2 from the rear side and are supported against the collar 21 as described above; in order to ensure that they are safely fixed in location, a plug 3 is inserted into the through hole 2 from behind for each gem 4. Therein, the plugs 3 each have a recess 31 on their forward front face, said recess 31 being designed such that the gem 4 can be received therein in an appropriate manner. In the case of cut diamonds, the recess of the plug therefore has the shape of a circular cone. On the rear side facing the cover plate 6, the plugs 3 terminate flush with the surface of the base plate 1.

In order to achieve an improved seating of the plugs 3 in the holes 2, the holes 2 each have a cylindrical depression 23 on their end facing the rear side, the shape of said cylindrical depression 23 virtually being applied from the plugs 3 as a negative image. This allows achieving an improved seal in order to ensure that dirt, liquids or the like are prevented from reaching the gems from the rear side.

Contrary to known types of attaching gems to belt buckles, the construction of the belt buckle 10 according to the invention excludes that gems 4 get lost because they are inserted from behind and are held in the holes 2 in a form-locking manner. Despite the secure attachment, the appearance is not affected therein; since a relatively narrow collar 21 suffices for retaining the gems 4 in a form-locking manner, the former hardly attracts attention when viewed from the front so that the gems 4 are fully shown to advantage.

Figure 5:
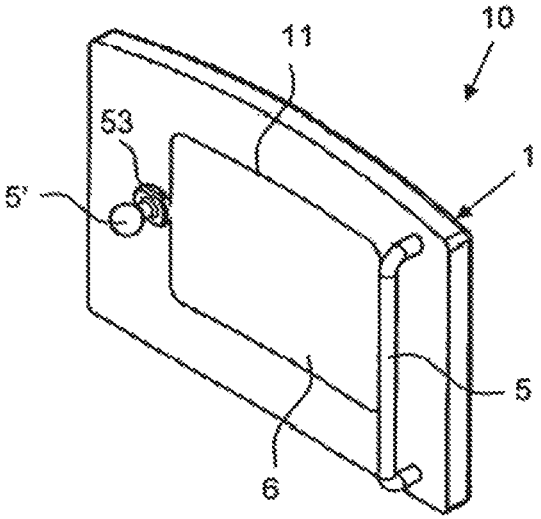

FIG. 5 is a rear view of the belt buckle 10 in perspective. A recess 11 which is disposed in the vicinity of the through holes 2 is provided on the rear side of the base plate 1. After the gems have been inserted, the recess 11 is closed with a cover plate 6 which is a cover of sorts that fits flush in the recess 11 and, in particular, does not project beyond the base plate on the rear side. On its short side, the cover plate 6 is protected against falling out by the collar 51 of the ball head 5' projecting beyond the edge of the cover plate 6 in part and therefore retains the latter in a form-locking manner.

Figure 6B:
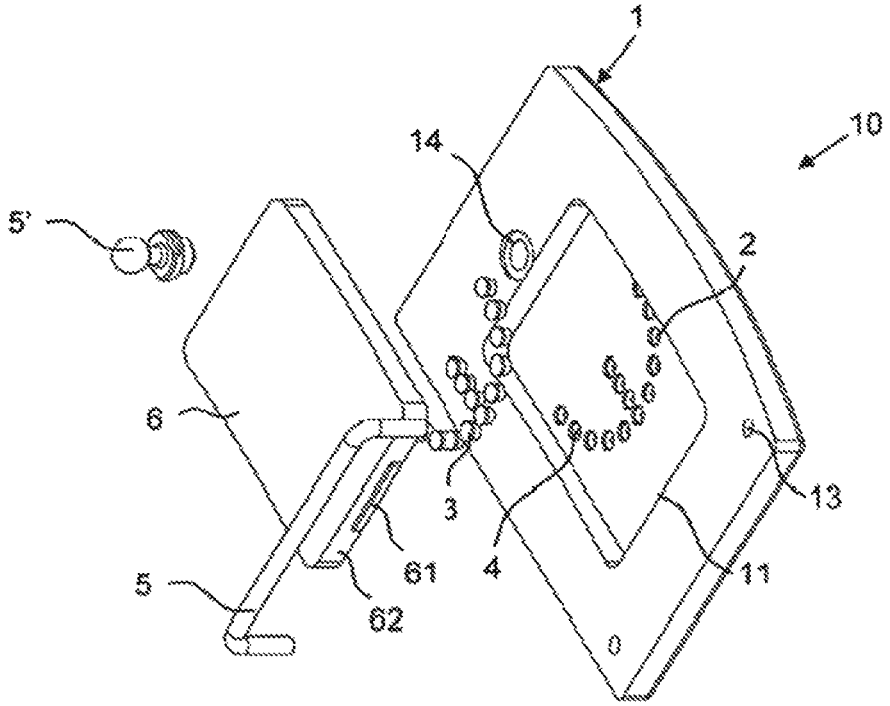

FIG. 6*a* and FIG. 6*b* finally are two exploded views of the belt buckle according to the invention in two different perspectives; this allows easily recognizing the assembly. The bracket 5 is inserted into the receiving holes 13 of the base plate 1 and fixed in location, for example soldered, in an appropriate manner. After the cover plate 6 has been fitted in the recess 11, the knob or ball head 5' is inserted in a corresponding receiving hole 14 and can, for example, be secured therein via a thread, a bayonet catch or the like.

On a short narrow side 62, the cover plate 6 includes a projecting lug 61 which is provided to engage the slot 15 disposed at the short edge of the recess 11 of the base plate 1 in a form-locking manner. This means that, to be mounted, the cover plate 6 is fitted in the recess 11 while being slightly tilted, with the result that the engagement of the lug 61 and the slot 15 is achieved; subsequently, the cover plate 6 is inserted flush into the recess. Only thereafter will the knob or ball head 5' be screwed into the threaded hole 14 with its thread 52, because the collar area 51 of the ball head 5' is designed such that it overlaps the edge of the cover plate 6 in part and therefore allows a form-locking attachment on the other short side.

FIGS. 7*a* and 7*b* show a first variant of a gem in the form of a ring. A through hole 2 is disposed in the base body of the ring; therein, a hole 24 is made from inside the ring (the inside being the rear side in the illustrated instance), said hole 24 forming the collar 21 on which the gem 4 is supported at the end of the through hole 2 facing outside. The plug 3 is inserted into the through hole 2 from inside, in order to hold the gem 4. The plug 3 can either be inserted into the through hole 2 in a force-locking manner or screwed into the through hole 2 via a thread 33 which is disposed in the end section of the through hole 2 facing inside (see FIG. 7*b*). To be screwed in, the plug which, in this case, can be a threaded pin can have a tool attachment 32, for example, a hexagon socket. The plug can also be simply grouted, which can even be achieved when metals, such as steel, are used.

In the variant of the ring shown in FIG. 7*c*, the plug 3 is not screwed in but rather just put into the through hole 2 in a force-locking manner. In addition, an inner ring 7 is provided which is coaxially inserted into the base body which, in the illustrated instance, virtually is an outer ring, in order to secure the plug 3. The person skilled in the art knows how to connect the inner ring 7 and the outer ring. If the thickness of the outer ring does not suffice to completely receive the gem (along its height), however, it can also be provided that a "seat bore" corresponding to the position of the through hole is present, said seat bore receiving the end of the gem facing inside. This is, however, not shown in the figures.

FIG. 8 shows an earring which has a plurality of through holes 2 each of which receives gems 4 in the manner described above. As a matter of course, the invention covers any other forms of earrings, ear studs or the like, as well as all other adorning elements which are mentioned in the description.

The invention claimed is:

1. An adorning element comprising:

a base body of metal having a front side and a rear side;

at least one gem disposed in the base body;

at least one through opening, wherein each gem is disposed in a respective through opening in the base body, and wherein the respective through opening extends from the front side to the rear side of the base body;

a circumferential collar forming a retaining element disposed at an end of the respective through opening and projecting into the respective through opening facing the front side of the base body, each gem being supported by the collar; and a holding device arranged at the at least one through opening on the rear side of the base body holding each gem in a defined position in the at least one through opening, wherein the holding device comprises a cover plate and a fixing element in each respective through opening, wherein the cover plate covers the at least one through opening and a vicinity of the at least one through opening on the rear side of the base body such that each gem is held in a defined position in the respective through opening, wherein the fixing element is covered by the cover plate, wherein the fixing element is a plug extending over an entire diameter of the respective through opening, wherein the plug has a recess, wherein a surface of the recess contacts the gem, wherein the at least one gem is a plurality of gems, and wherein the gems are arranged in a defined pattern in form of letters, numerals or symbols.

2. The adorning element according to claim 1, wherein the circumferential collar in the respective through opening is formed by forming a first hole from the rear side of the base body to the front side, and wherein a respective through hole is coaxially formed with the first hole, and wherein the respective through hole has a diameter which is larger than a diameter of the first hole.

3. The adorning element according to claim 1, wherein the base body comprises at least one closing device, and wherein the at least one closing device is selected from the group consisting of a bracket, a knob, a ball head and a spike.

4. The adorning element according to claim 3, wherein the at least one closing device is received in the base body by a receiving hole or is forged or cast or screwed to the base body, or wherein the at least one closing device is selected from the group consisting of an eye, a groove and a recess.

5. The adorning element according to claim 4, wherein the knob, ball head or spike comprises a collar which extends in a radially outward direction in relation to its longitudinal axis, and wherein the receiving hole for the knob, ball head or spike is arranged such that the collar overlaps an edge of the cover plate.

6. The adorning element according to claim 3, wherein at least the base body or the base body and the at least one closing device consist essentially of metal selected from the group consisting of platinum, gold, silver, a metal alloy, stainless steel and a combination thereof, and wherein the base body and the at least one closing device include identical or different metals.

7. The adorning element according to claim 1, wherein the respective through opening comprises a cylindrical depression at the end facing the rear side of the base body.

8. The adorning element according to claim 1, wherein the plug consists essentially of a plastic material or a metal.

9. The adorning element according to claim 1, wherein the plug is a clamping ring that is supported on a lateral surface of the respective through opening.

10. The adorning element according to claim 1, wherein the plug is a threaded pin or a screw that is screwed into a threaded section at a rear side of the respective through opening.

11. The adorning element according to claim 1, wherein the cover plate configured to cover the at least one through opening on the rear side of the base body is inserted into a rear-sided recess of the base body in a detachable or undetachable manner.

12. The adorning element according to claim 1, wherein the cover plate comprises an engagement element at least on one side which is configured to be brought into engagement with a mating engagement element which is disposed in a recess of the base body, or is articulated to the base body via one or a plurality of hinges.

13. The adorning element according to claim 1, wherein the at least one gem has a circular basic cross-section and comprises a brilliant cut or a brilliant cut form, is a diamond, has an oval or polygonal basic cross-section and comprises a crystal form or a cut form, is a crystal, is a synthetic gem with a cut, or is a non-diamond natural gem with or without cut.

14. The adorning element according to claim 1, wherein the base body is a clasp, or wherein the base body is a base plate that is curved at least along one axis, or wherein the at least one gem is disposed in the base plate, and wherein at least one closing element is arranged on the rear side of the base plate.

15. The adorning element according to claim 14, wherein the clasp is a belt buckle, a book clasp, a purse clasp, a jacket clasp, a shoe clasp, a bag clasp, a suitcase clasp, a knapsack clasp, a clasp for a case of a mobile electronic terminal device, a clock clasp, a clasp for a pair of trousers, a clasp for braces, a clasp for a cosmetic bag, or a clasp for a suit bag.

16. The adorning element according to claim 1, wherein the adorning element is a key chain, a wristband, a bracelet, a case of an electronic terminal device, a ring, a necklace, a cuff button, a money clip, a hairslide, a button, an ear adorning element, a part of a necklace, a pendant, a decorating part for hats gloves, a collar, a decorating part for sports accessories in equestrian spoils, golf, tennis or other spoils accessories, or a temple stem or a tie pin.

17. The adorning element according to claim 1, wherein the respective through opening is a through hole.

18. The adorning element according to claim 1, wherein the plug has a front-sided recess that maps a negative shape of a rear side of the gem.

19. The adorning element according to claim 1, wherein the plug has a negative shape of the through opening.

20. An adorning element comprising:

a base body of metal having a front side and a rear side;

at least one gem disposed in the base body;

at least one through opening, wherein each gem is disposed in a respective through opening in the base body, and wherein the respective through opening extends from the front side to the rear side of the base body;

a circumferential collar forming a retaining element disposed at an end of the respective through opening and projecting into the respective through opening facing the front side of the base body, each gem being supported by the collar; and a holding device arranged at the at least one through opening on the rear side of the base body holding each gem in a defined position in the at least one through opening, wherein the holding device comprises a cover plate and a fixing element in each respective through opening, wherein the cover plate covers the at least one through opening and a vicinity of the at least one through opening on the rear side of the base body such that each gem is held in a defined position in the respective through opening, wherein the fixing element is covered by the cover plate, wherein the fixing element is a plug extending over an entire diameter of the respective through opening, wherein the plug has a recess, wherein a surface of the recess contacts the gem, wherein the at least one gem is a plurality of gems, and wherein the gems are arranged across a whole or a partial surface of the base body.

21. An adorning element comprising:

a base body of metal having a front side and a rear side;

at least one gem disposed in the base body;

at least one through opening, wherein each gem is disposed in a respective through opening in the base body, and wherein the respective through opening extends from the front side to the rear side of the base body;

a circumferential collar forming a retaining element disposed at an end of the respective through opening and projecting into the respective through opening facing the front side of the base body, each gem being supported by the collar; and a holding device arranged at the at least one through opening on the rear side of the base body holding each gem in a defined position in the at least one through opening, wherein the holding device comprises a cover plate and a fixing element in each respective through opening, wherein the cover plate covers the at least one through opening and a vicinity of the at least one through opening on the rear side of the base body such that each gem is held in a defined position in the respective through opening, wherein the fixing element is covered by the cover plate, wherein the fixing element is a plug extending over an entire diameter of the respective through opening, wherein the plug has a recess, wherein a surface of the recess contacts the gem, wherein the at least one gem is a plurality of gems, and wherein, when a surface of the base body is only partially occupied, a form corresponding to a defined pattern is left unoccupied and raised.

22. An adorning element comprising:

a base body of metal having a front side and a rear side;

at least one gem disposed in the base body;

at least one through opening, wherein each gem is disposed in a respective through opening in the base body, and wherein the respective through opening extends from the front side to the rear side of the base body;

a circumferential collar forming a retaining element disposed at an end of the respective through opening and projecting into the respective through opening facing the front side of the base body, each gem being supported by the collar; and a holding device arranged at the at least one through opening on the rear side of the base body holding each gem in a defined position in the at least one through opening, wherein the holding device comprises a cover plate and a fixing element in each respective through opening, wherein the cover plate covers the at least one through opening and a vicinity of the at least one through opening on the rear side of the base body such that each gem is held in a defined position in the respective through opening, wherein the fixing element is covered by the cover plate, wherein the fixing element is a plug extending over an entire diameter of the respective through opening, wherein the plug has a recess, wherein a surface of the recess contacts the gem, wherein the base body comprises at least one closing device, wherein the at least one closing device is selected from the group consisting of a bracket, a knob, a ball head and a spike, wherein the at least one closing device is received in the base body by a receiving hole or is forged or cast or screwed to the base body, or wherein the at least one closing device is selected from the group consisting of an eye, a groove and a recess, and wherein the knob, ball head or spike comprises a collar which extends in a radially outward direction in relation to its longitudinal axis, and wherein the receiving hole for the knob, ball head or spike is arranged such that the collar overlaps an edge of the cover plate.

* * * * *